US006428408B1

(12) United States Patent
Bell et al.

(10) Patent No.: US 6,428,408 B1
(45) Date of Patent: Aug. 6, 2002

(54) LOW FLOW FUME HOOD

(75) Inventors: Geoffrey C. Bell, Pleasant Hill; Helmut E. Feustel, Albany; Darryl J. Dickerhoff, Berkeley, all of CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/574,711

(22) Filed: May 18, 2000

(51) Int. Cl.[7] ..... B08G 15/02

(52) U.S. Cl. ..... 454/56; 454/57; 454/59; 454/62

(58) Field of Search ..... 454/56, 57, 59, 454/62; 422/104; 126/299 R, 299 D

(56) References Cited

U.S. PATENT DOCUMENTS

| | | | | |
|---|---|---|---|---|
| 2,649,727 A | | 8/1953 | Snow et al. | |
| 3,021,776 A | | 2/1962 | Kennedy | |
| 3,237,548 A | * | 3/1966 | Bayern | 454/59 |
| 3,496,857 A | | 2/1970 | Ellis et al. | |
| 3,747,504 A | * | 7/1973 | Turko et al. | 454/59 |
| 4,023,473 A | * | 5/1977 | Russell | 454/59 |
| 4,436,022 A | * | 3/1984 | Zboralski et al. | 454/59 |
| 4,475,534 A | | 10/1984 | Moriarty | |
| 4,550,650 A | | 11/1985 | Denner et al. | |
| 4,553,475 A | | 11/1985 | Saunders | |
| 4,590,847 A | | 5/1986 | Hull | |
| 4,856,420 A | * | 8/1989 | Poblete et al. | 454/59 |
| 5,113,749 A | | 5/1992 | Perbix | |
| 5,167,572 A | | 12/1992 | Etkin | |
| 5,251,608 A | * | 10/1993 | Cote | 126/299 D |
| 6,089,970 A | | 7/2000 | Feustel | |

FOREIGN PATENT DOCUMENTS

| | | |
|---|---|---|
| CA | 1009495 | 5/1977 |
| CA | 1126566 | 6/1982 |

OTHER PUBLICATIONS

Daisey, Joan M., "Low–Flow Fume Hood", *Indoor Environment Program 1995 Annual Report,* pp. 10–11, (Published Apr. 8, 1997).

Monsen, R.R., "Practical Solutions to Retrofitting Existing Fume Hoods and Laboratories", ASHRA Transactions, pp. 845–851 (1987).

Maust, et al., "Laboratory Fume Hood Systems, Their use and Energy Conservation", ASHRAE Transactions, pp. 1813–1821 (1987).

* cited by examiner

*Primary Examiner*—Jiping Lu
(74) *Attorney, Agent, or Firm*—Beyer, Weaver & Thomas, LLP

(57) ABSTRACT

A fume hood is provided having an adequate level of safety while reducing the amount of air exhausted from the hood. A displacement flow fume hood works on the principal of a displacement flow which displaces the volume currently present in the hood using a push-pull system. The displacement flow includes a plurality of air supplies which provide fresh air, preferably having laminar flow, to the fume hood. The displacement flow fume hood also includes an air exhaust which pulls air from the work chamber in a minimally turbulent manner. As the displacement flow produces a substantially consistent and minimally turbulent flow in the hood, inconsistent flow patterns associated with contaminant escape from the hood are minimized. The displacement flow fume hood largely reduces the need to exhaust large amounts of air from the hood. It has been shown that exhaust air flow reductions of up to 70% are possible without a decrease in the hood's containment performance. The fume hood also includes a number of structural adaptations which facilitate consistent and minimally turbulent flow within a fume hood.

31 Claims, 7 Drawing Sheets

LOW FLOW FUME HOOD

STATEMENT REGARDING FEDERALLY SPONSORED RESEARCH

This invention was made with government support under Grant (Contract) No. DE-AC03-76SF00098 awarded by The U.S. Department of Energy. The government has certain rights to this invention.

BACKGROUND OF THE INVENTION

This invention relates generally to fume hoods, and in particular to energy-efficient laboratory fume hoods. More specifically, the invention relates to laboratory fume hoods which use low flow rates and further relates to structural features which facilitate containment of contaminants in a fume hood.

A fume hood may be generally described as a ventilated enclosed workspace intended to capture, contain, and exhaust fumes, vapors, and particulate matter generated inside the enclosure. The purpose of a fume hood is to draw fumes and other airborne matter generated within a work chamber away from a worker, so that inhalation of contaminants is minimized. The concentration of contaminants to which a worker is exposed should be kept as low as possible and should never exceed a safety threshold limit value. Such safety thresholds and other factors relating to testing and performance of laboratory fume hoods are prescribed by government and industry standards by organizations, such as the American Society of Heating, Refrigerating and Air-Conditioning Engineers, Inc. (ASHRAE) of Atlanta, Ga., for example, ANSI/ASHRAE 110-1995. ASHAAE Standard, "Method of Testing Performance of Laboratory Fume Hoods." This and all other documents cited in this application are incorporated herein by reference for all purposes.

FIG. 1 shows a cross-sectional side view of a conventional fume hood. The hood 100 includes a work chamber 102, bounded by walls 103 and a front open face 105 which may be covered partially or completely by a moveable sash 114. The hood may be supported by a base 104. In many designs, the base contains cabinets for storage of solvents and other materials used in the hood's work chamber 102.

While hood sizes vary considerably, a typical conventional fume hood is about 4 to 10 feet wide with a sash opening of between about 26 and 34 inches, and a standard interior vertical size of about 52 inches. The hood's sidewalls 103 typically have considerable thickness because they contain mechanical and electrical services for the hood. Again, while dimensions of fume hoods greatly vary, the depth of a typical fume hood ranges from about 32 to about 37 inches. A typical conventional hood design includes an air foil 106 at the bottom front of the work chamber 102 and a baffle 108 at the rear of the work chamber 102. The depth of the work chamber 102 between these two features 106 and 108 is typically approximately 21 inches.

The opening in the front of the fume hood 100 which provides access to the work chamber 102 by a worker, is referred to as the face of the fume hood. In some conventional fume hood designs, referred to as open-faced hoods, the face area of the hood is fixed. In other designs, such as that depicted in FIG. 1, the moveable sash 114 provides the ability to alter the face area of the hood 100. Sashes come in either vertical or horizontal arrangements, with the vertical design typically being preferred since it can provide a full open face area.

Other elements of conventional fume hoods illustrated in FIG. 1 include an air bypass area 116 above the sash in the top front of the fume hood 100 which provides an additional path for ambient air to enter the work chamber 102. The bypass 116 provides sufficient air flow to dilute contaminants in the hood, and to avoid air whistling when the sash 114 is closed. Air is exhausted from the fume hood through an exhaust system equipped with a fan (not shown) which draws air into the fume hood's work chamber 102, through the baffle 108, and into ducting 118 outside the work chamber 102 of the fume hood 100 for exhaustion from the building. The top wall of the fume hood is also typically equipped with a light fixture 120 to illuminate the work chamber 102. The back baffle 108 typically includes two or three horizontally disposed slots to direct air flow within the work chamber 102. Further details regarding the design and construction of conventional laboratory fume hoods may be found in Sanders G. T., 1993. Laboratory Fume Hoods, A User's Manual. John Wiley & Sons, Inc.

Containment of contaminants in many conventional fume hoods is based on the principal of supplying an abundant amount of air into the face of the hood and withdrawing this air, along with the contaminants, from the work chamber. As noted above, the face corresponds to the area below the sash (in the case of a vertical sash arrangement) at the front of the hood through which air enters the work chamber. This abundant amount of air is supplied at a high enough rate such that contaminants within the hood are prevented from moving against the incoming air entering the face of the hood. Under conventional principles, air flow is typically increased to improve containment of contaminants within the work chamber.

An important factor in a conventional fume hood's ability to contain contaminants is its face velocity. The face velocity of a fume hood is determined by its exhaust and its open face area. Recommendations for face velocity of conventional fume hoods range from 75 feet per minute (fpm) for materials of low toxicity (Class C: TLV>500 ppm) to 130 fpm for extremely toxic or hazardous materials (Class A: TLV<10 ppm). Cooper, E. C., 1994. *Laboratory Design Handbook*, CRC Press. In general, industrial hygienists recommend face velocities in the range of 100 fpm plus or minus 10 fpm for containment of contaminants by conventional hoods with open sashes.

Face velocities at these speeds typically produce turbulent air flow conditions within the hood. As a result, unpredictable and inconsistent air flow patterns, such as vortices near exhaust outlets and near the face of the hood, often occur. The unpredictability of turbulent air flow conditions within the hood may result in reversal of flow near the face of the hood despite the high velocity of incoming air, causing contaminants to spill from the hood's work chamber into the surrounding laboratory space. Turbulent air flow within the hood also increases mixing between the fresh air and other airborne contaminants generated within the work chamber.

The abundant amount of air supply provided to the hood and turbulent air flow conditions formed therein are often compounded by conventional fume hood design. FIG. 2 shows a cross-sectional side view of a conventional fume hood design, such as that illustrated in FIG. 1, further illustrating ideal air flow through such a conventional hood. Air is shown entering the hood 200 from the surrounding laboratory space 201 by arrows 202. The air flows through the open face 203 of the hood 200 defined by the fully open sash 206 and the air foil 208 into the work chamber 205. Inside the work chamber 205 the air is drawn towards slots 204 in the baffle 207 at the rear of the work chamber 205. In the particular design depicted in FIG. 2, the air flow generated by the slots establishes a vortex 210 in the upper region of the work chamber. If this vortex extends to or below the upper limit of the open face 203, the risk of spillage of airborne contaminants from the hood 200 is increased. Having passed through the baffle 207, the air is then exhausted through the exhaust system 212.

In addition to the hood design, the position of the worker with respect to the air flow direction may have a significant influence on the air flow patterns in the hood, and particularly in the face of the hood. Air flows surrounding a body standing in front of the hood create a region of low pressure downstream of the body. This region, which is deficient in momentum, is called the wake. It disturbs the directed air flow in the face of the hood, adding to any turbulence and may further result in reversal of flow causing contaminants to spill from the hood's work chamber into the surrounding laboratory space.

As described above, the air source for conventional fume hoods is the ambient air in a laboratory in which the fume hood is located. The additional air which must be provided to a laboratory space by a building's HVAC system to replace air exhausted by a fume hood is referred to as "make-up air." Since make-up air is supplied as part of the laboratory's ambient air, it must be conditioned to the same degree if comfort and safety levels in the laboratory are to be maintained. As a result, laboratory buildings have very high energy intensities. Conditioning of the make-up air to be exhausted by fume hoods uses most of the energy beyond what is required for technical apparatus and lighting in laboratory environments. The high energy consumption caused by fume hood exhaust air flows is a result of both the need to condition make-up air and in conventional systems and to move it through a building's air flow handling system. Thus, the abundant amount of air provided for the operation of conventional laboratory fume hoods results in a tremendous energy wastage.

Accordingly, alternative fume hood designs which reduce the amount of air required for operability, reduce energy consumption and provide containment of contaminants would be desirable.

SUMMARY OF THE INVENTION

To achieve the foregoing, the present invention provides a fume hood that offers an adequate containment of contaminants while reducing the amount of air exhausted from the hood. The fume hood includes a plurality of air supply outlets which provide fresh air, preferably having laminar flow, to the fume hood. The fume hood also includes an air exhaust which pulls air from the work chamber in a minimally turbulent manner. The push of the air supply outlets and the pull of the air exhaust form a push-pull system that provides a low velocity displacement flow which displaces the volume of gases currently present in the hood in a minimally turbulent and substantially consistent manner. As a result, inconsistent flow patterns associated with turbulent air supply and contaminant escape from the fume hood are minimized. The displacement flow fume hood in accordance with one embodiment of the present invention largely reduces the need to exhaust large amounts of air from the hood. It has been shown that exhaust air flow reductions of up to 70% are possible without a decrease in the hood's containment performance.

The present invention includes a number of structural features which facilitate consistent and minimally turbulent flow within a fume hood. In one embodiment, the present invention includes a tapered wall on the top of the work chamber which facilitates flow towards an upper air outlet from the chamber and minimizes the formation of vortices near the top of the chamber. In another embodiment, the present invention includes an air supply within the work chamber to facilitate flow of gases in a minimally turbulent and substantially consistent manner.

In one aspect, the invention relates to a fume hood. The fume hood includes a partially enclosed work chamber having a front open face, a first top air source at the face of the work chamber, and a second top air source inside the face of the work chamber. The fume hood additionally includes a bottom air source at the face of the work chamber, and at least one air exhaust outlet from the work chamber.

In another aspect, the invention relates to a fume hood including a partially enclosed work chamber having a front open face and a top angled wall partially enclosing the work chamber. The fume hood also includes a top air source at the face of the work chamber, a bottom air source at the face of the work chamber, and at least one air exhaust outlet from the work chamber.

In yet another aspect, invention relates to a displacement flow fume hood including a partially enclosed work chamber having a front open face, the front open face having a front open face area. The displacement flow fume hood also includes a first top air source at the face of the work chamber, a second top air source, and a bottom air source at the face of the work chamber. The displacement flow fume hood further includes at least one air exhaust outlet associated with a work chamber outlet, the work chamber outlet having an outlet area, wherein the work chamber has a cross section area along a line of air flow between the open face and the work chamber outlet which is greater than the front open face area and which is greater than the chamber outlet area.

In another aspect, the invention relates to a method of preventing airborne contaminants from escaping through the face of a fume hood, the fume hood having a partially enclosed work chamber having a front open face. The method comprising supplying an air flow to said face through a plurality of air sources including a first top air source at the face of the work chamber, a second top air source inside the work chamber, and a bottom air source at the face of the work chamber.

These and other features and advantages of the present invention are described below with reference to the drawings.

DETAILED DESCRIPTION OF THE PREFERRED EMBODIMENTS

Figure 1:
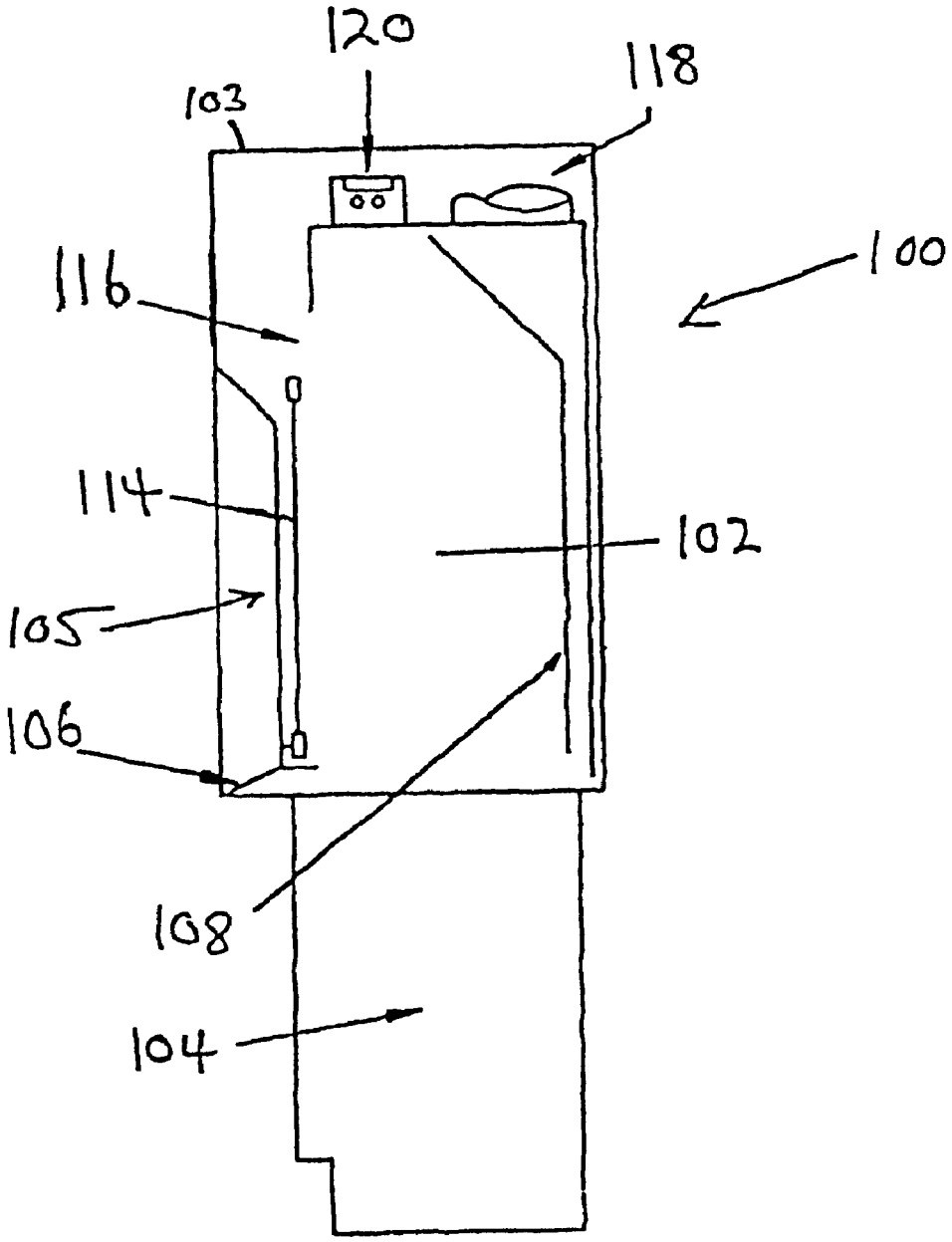
FIGURE 1 (PRIOR ART)
FIG. 1 is a cross-sectional side view of a conventional laboratory fume hood.
Figure 2:
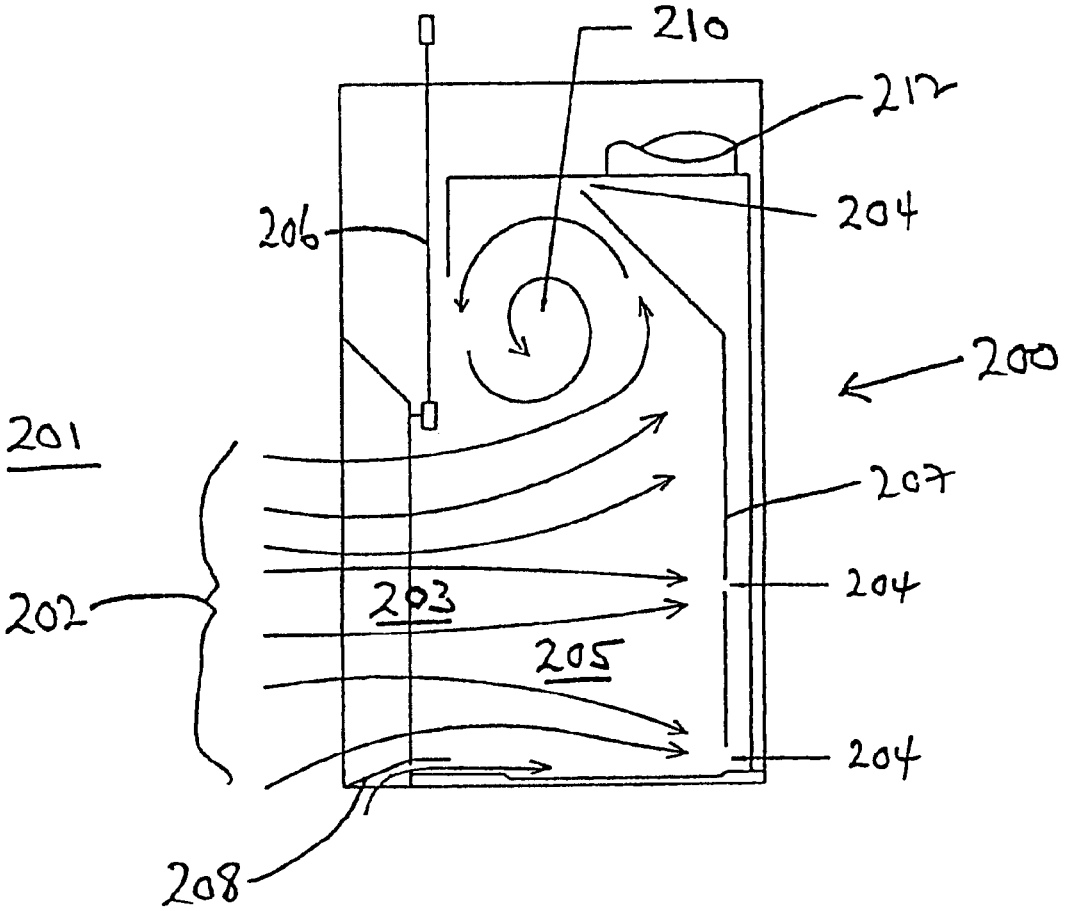
FIGURE 2 (PRIOR ART)
FIG. 2 is a cross-sectional side view showing air flow in a conventional laboratory fume hood.

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known process operations have not been described in detail in order not to unnecessarily obscure the present invention.

The present invention provides a fume hood that offers improved containment of contaminants while reducing the amount of air used during operation. To accomplish this, the present invention includes a number of structural adaptations to conventional fume hood design. While the performance of a conventional fume hood depends on an abundant amount of air supply through the face of the hood, the present invention according to one aspect works on the principal of a push-pull system within the hood. The push-pull system uses an air supply which gently pushes on air in the fume hood in a minimally turbulent and consistent manner towards an exhaust, which gently pulls on the air. The push-pull system provides a displacement flow for air in the hood which consistently displaces gases in the work chamber and which minimizes turbulent and inconsistent air patterns within the fume hood, such as vortices near the face. As a result, the displacement flow is more effective in preventing spillage of contaminants outside the fume hood. To facilitate the push-pull system, the present invention includes a number of structural adaptations to conventional fume hood design.

The air supply includes fresh air supplied between the person working in front of the hood and the work chamber. In some embodiments, the air supply also includes fresh air supplied within the hood to facilitate the displacement flow and minimize turbulent air patterns in the fume hood. The air flow supplied displaces the volume currently present in the hood in a substantially consistent manner without significant mixing between fresh air and work chamber gases and with minimum injection of fresh air. By reducing the amount of air used to contain contaminants, the displacement flow fume hood in accordance with the present invention largely reduces the need to exhaust large amounts of air from the hood.

One embodiment of a laboratory fume hood in accordance with the present invention is illustrated in FIGS. 3A–E. While it is believed that the primary application of the fume hood of the present invention will be in research and industrial laboratories, it should be understood that the invention is applicable to any situation where containment of airborne contaminants (e.g., as a wet bench in semiconductor manufacturing, etc.) or convective heat flow is an issue. Moreover, the described embodiment incorporates several features which contribute to the beneficial results achieved by fume hoods designed in accordance with the present invention. Other embodiments of the invention may include only some of these features, as further described and claimed herein.

Figure 3A:
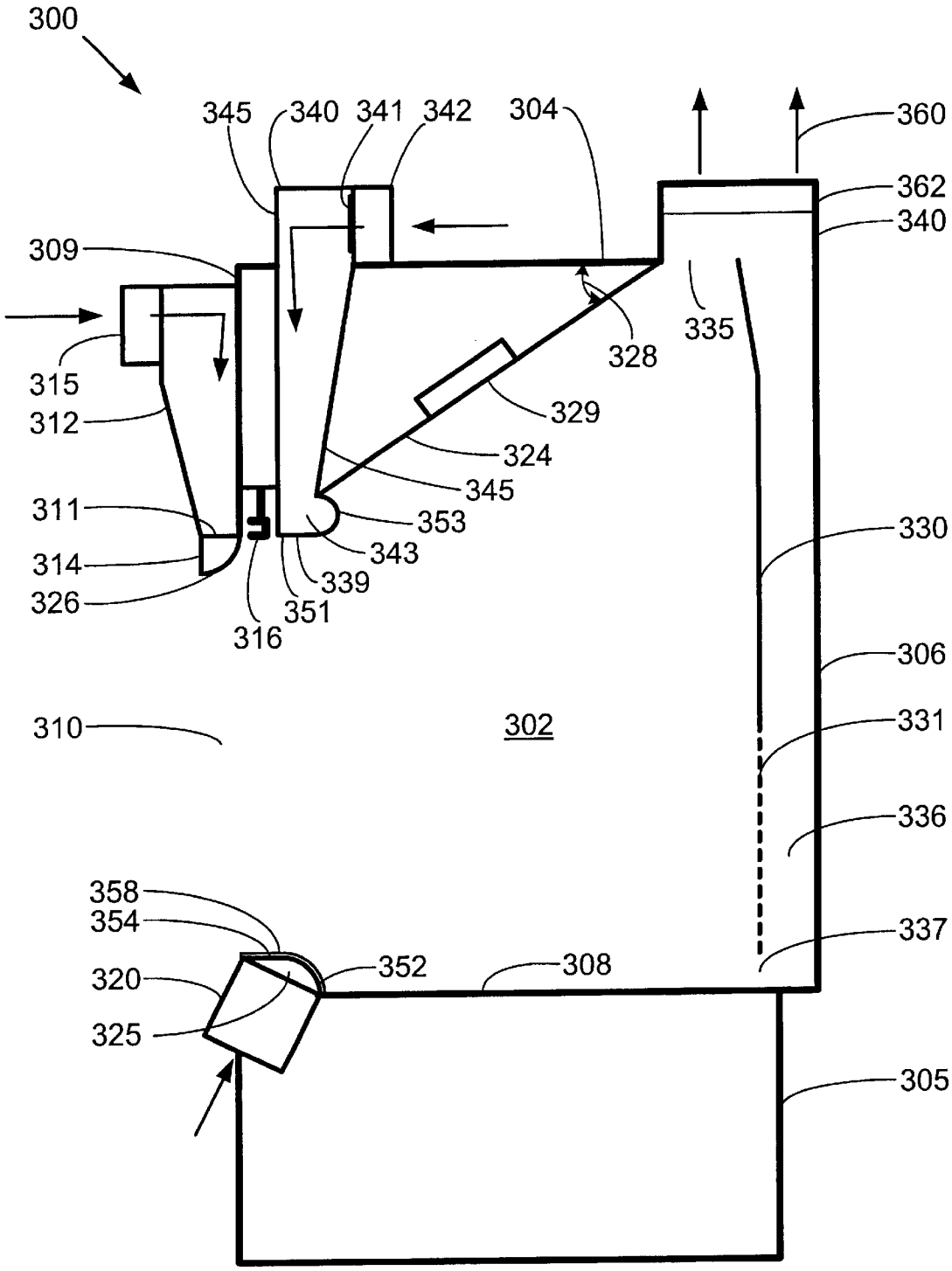
FIG. 3A is a cross-sectional side view of a fume hood in accordance with one embodiment of the present invention.
Figure 3B:
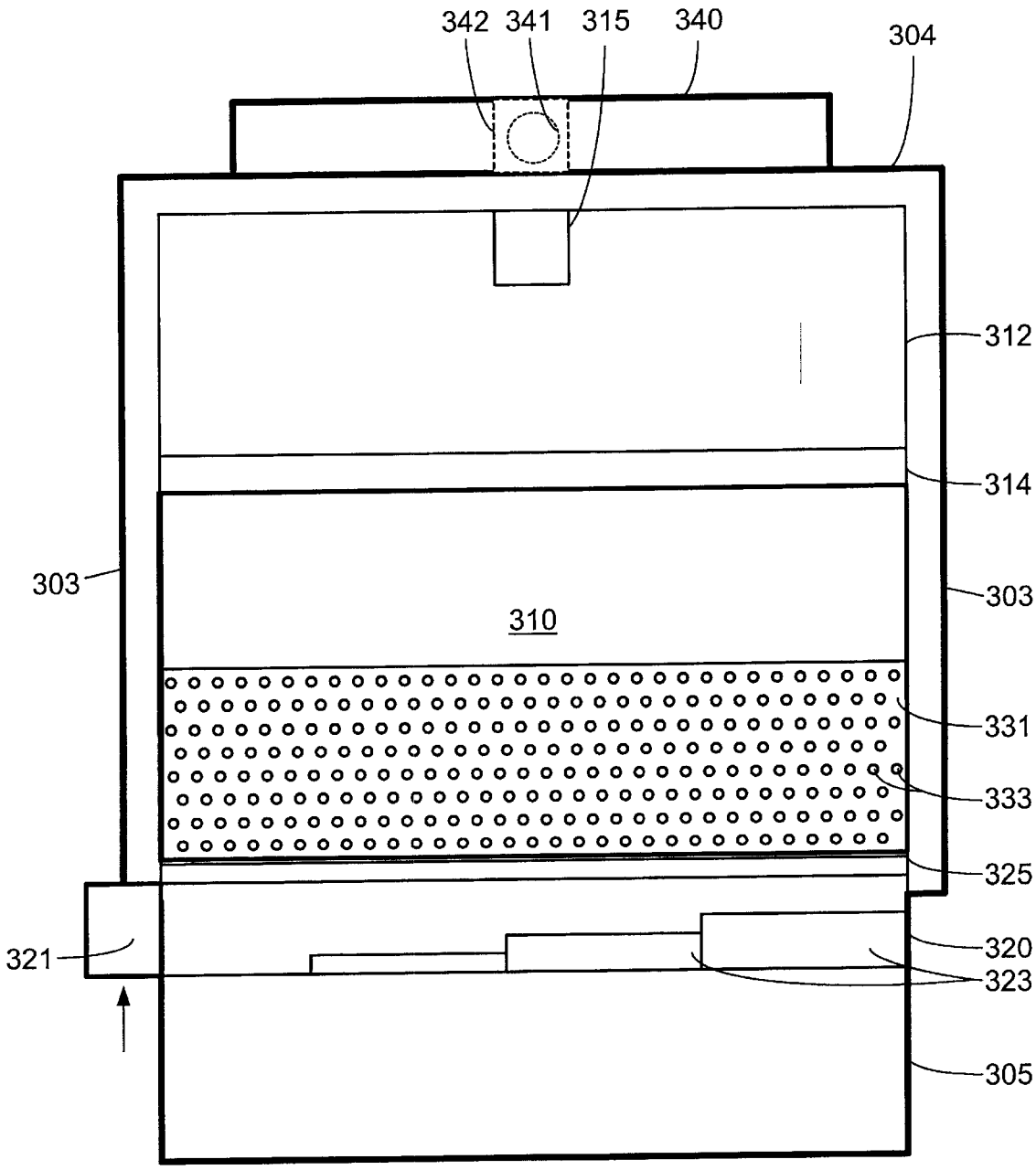
FIG. 3B is a front view of the fume hood of FIG. 3A in accordance with one embodiment of the present invention.

As shown in FIGS. 3A and 3B, the fume hood 300 includes many elements of conventional fume hoods, with several structural adaptations in accordance with the present invention. In this implementation of the present invention, the fume hood 300 includes a work chamber 302 defined by side enclosure panels 303 (FIG. 3B), a top enclosure panel 304, a back enclosure panel 306, a bottom work area panel 308, a front partial enclosure panel 309, and a front open face 310. The hood 300 maybe supported by a base 305. In many designs, the base 305 contains cabinets for storage of solvents and other materials used in the hood's work chamber 302.

Figure 3C:
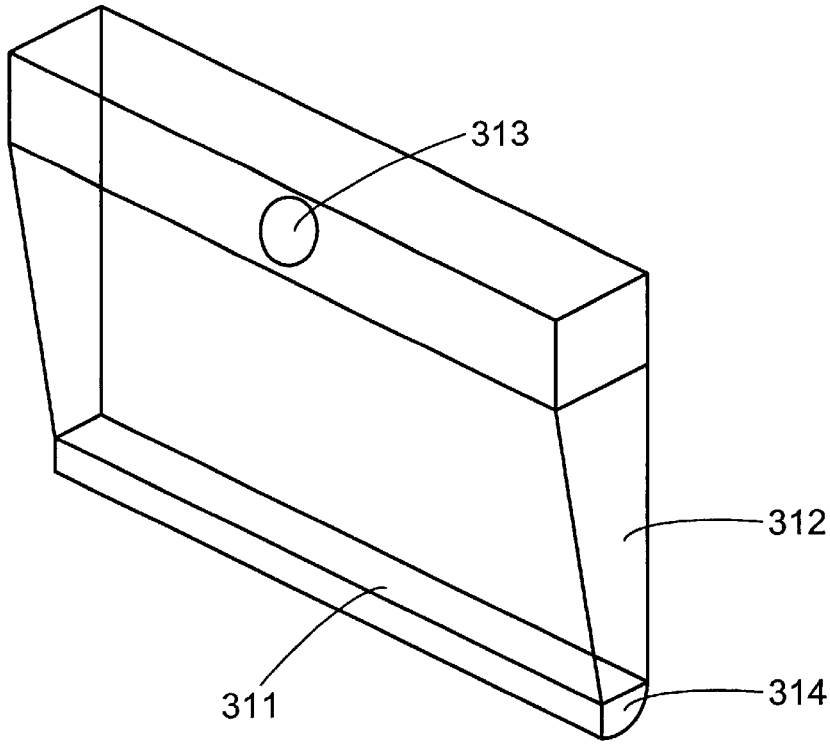
FIG. 3C depicts a perspective view of the top outside air plenum of FIG. 3A in accordance with one embodiment of the present invention.

Attached to the top enclosure panel 304 is a supply air plenum 312, also illustrated in perspective in isolation in FIG. 3C. The supply air plenum 312 draws air from the room in which the hood is located through a supply air inlet 313 equipped with a fan 315, and supplies it to a top air source 314. To obtain even velocity of the supply air over the whole width of the top air source 314, the supply air plenum 312 redirects air perpendicular to the air flow produced by the fan 315 into a larger area 311 of the supply air plenum 312 which spans the front open face 310 (FIG. 3B). The impact of the air hitting the back face of the air plenum 312 helps to evenly distribute the air over the width of the plenum. In addition, the larger area 311 of the supply air plenum 312 relative to the smaller area of the supply air inlet 313 slows the velocity of the air moving through the plenum 312. It should be noted that in alternative embodiments of the present invention, the fan arrangement may be replaced by, for example, a duct either connected to the supply air system, an auxiliary air system, or attached to a fan providing room air as described above.

Figure 3D:
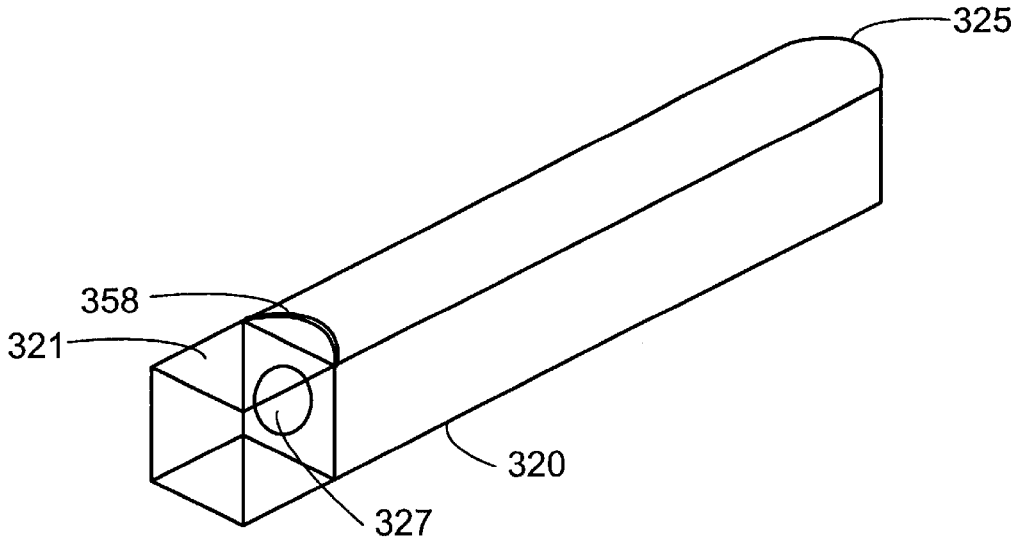
FIG. 3D depicts a perspective view of the bottom air plenum of FIG. 3A in accordance with one embodiment of the present invention.

Attached to the front of the hood below the front open face 310 is a bottom supply air plenum 320, also illustrated in isolation in the perspective drawing of FIG. 3D. The bottom supply air plenum 320 draws air from the room in which the hood is located through a supply air inlet 327 equipped with a fan 321, and supplies it to a bottom air source 325 for the hood. The bottom air source 325 and bottom supply air plenum 320 span the width of the front open face 310. To distribute supply air evenly over the whole width of the bottom air source 325, the bottom supply air plenum 320 includes one or more plenum air guides 323, as shown in FIG. 3B. The plenum air guides 323 reduce the cross-sectional area of the bottom supply air plenum 320 as the air moves across the width. Decreasing the cross-sectional area of the plenum 322 increases the velocity of air supplied by the fan 321 in the bottom supply air plenum 322 and helps provide substantially consistent air supply into the work chamber 302 from the bottom air source 325 across the width of the face 310.

In the embodiment of the invention illustrated in FIGS. 3A–B, the top enclosure panel 304 also contains an internal top supply air plenum 340 which supplies fresh air inside the work chamber 302. The internal top supply air plenum 340 receives air through a supply air inlet 341 equipped with a fan 342, to a internal air supply outlet 343 located at the in the upper interior of the hood 300. The internal air supply outlet 343 spans the width of the work chamber 302, and includes a substantially flat portion 351 and a curved portion 353. The curved portion 353 of the internal air supply outlet 343 may end at an intersection with a lower portion of the front/top wall of the work chamber 302, as described further below.

In one embodiment, the internal outlet 343 provides air to the work chamber 302 to improve containment of contaminants within the fume width 300 and help direct contaminants to exhaust outlets in the work chamber 302. In a specific embodiment, the internal outlet 343 provides air to the work chamber 302 to facilitate displacement flow. To obtain even velocity of the supply air over the whole width of the internal air supply outlet 343, the supply air plenum 340 redirects air perpendicular to the air flow produced by the fan 342 into a vertical portion 345 of the supply air plenum 340. The impact of the air hitting the front face of the air plenum 340 helps to evenly distribute the air over the whole width of the plenum.

As noted above with respect to the top air supply 314, while the air supplied to the supply air sources (outlets) 325 and 340 in this embodiment comes from ambient room air, alternative embodiments in accordance with the present invention may provide, for example, an auxiliary air supply to the supply air sources 325 and 340.

The top 304 and front 309 enclosure panels also enclose a housing for a moveable vertical sash 316 when it is in a retracted position as illustrated. While the sash 316 in this embodiment is a vertically-opening sash situated between the supply air plenums 312 and 340, other types of sashes, such as horizontally-opening sashes or vertically opening sashes located elsewhere in the fume hood 300, may also be used.

Air is exhausted from the fume hood 300 through an exhaust outlet 340 equipped with a fan 362 which draws air from the work chamber 302, through one or more work chamber outlets, for exhaustion from the building. The fume hood includes a top chamber outlet 335, a perforated baffle 331, and a slot 337 for removal of gases from the work chamber 302. Once the air is passed through the top chamber outlet 335, the baffle 331, and the slot 330, it is exhausted through the exhaust outlet 340 provided at the top rear of the hood 300 as shown by arrows 360.

In operation, the fume hood 300 works on the principal of a push-pull system. The outlets 314, 325 and 343 gently push on air in the work chamber 302 in a minimally turbulent and consistent manner towards the top chamber outlet 335, the baffle 331 and the slot 337, which gently pull the air into the exhaust outlet 340 using the exhaust fan 362. The air flow supplied displaces the volume currently present in the hood's face without significant mixing between the two volumes and with minimum injection of air. In addition, the push-pull system provides a displacement flow for air in the hood which minimizes vortices and turbulent flow within the fume hood, such as near the top of the work chamber 302 and the face 310. As a result, the displacement flow is more effective in preventing spillage of contaminants outside the face 310.

Figure 4A:
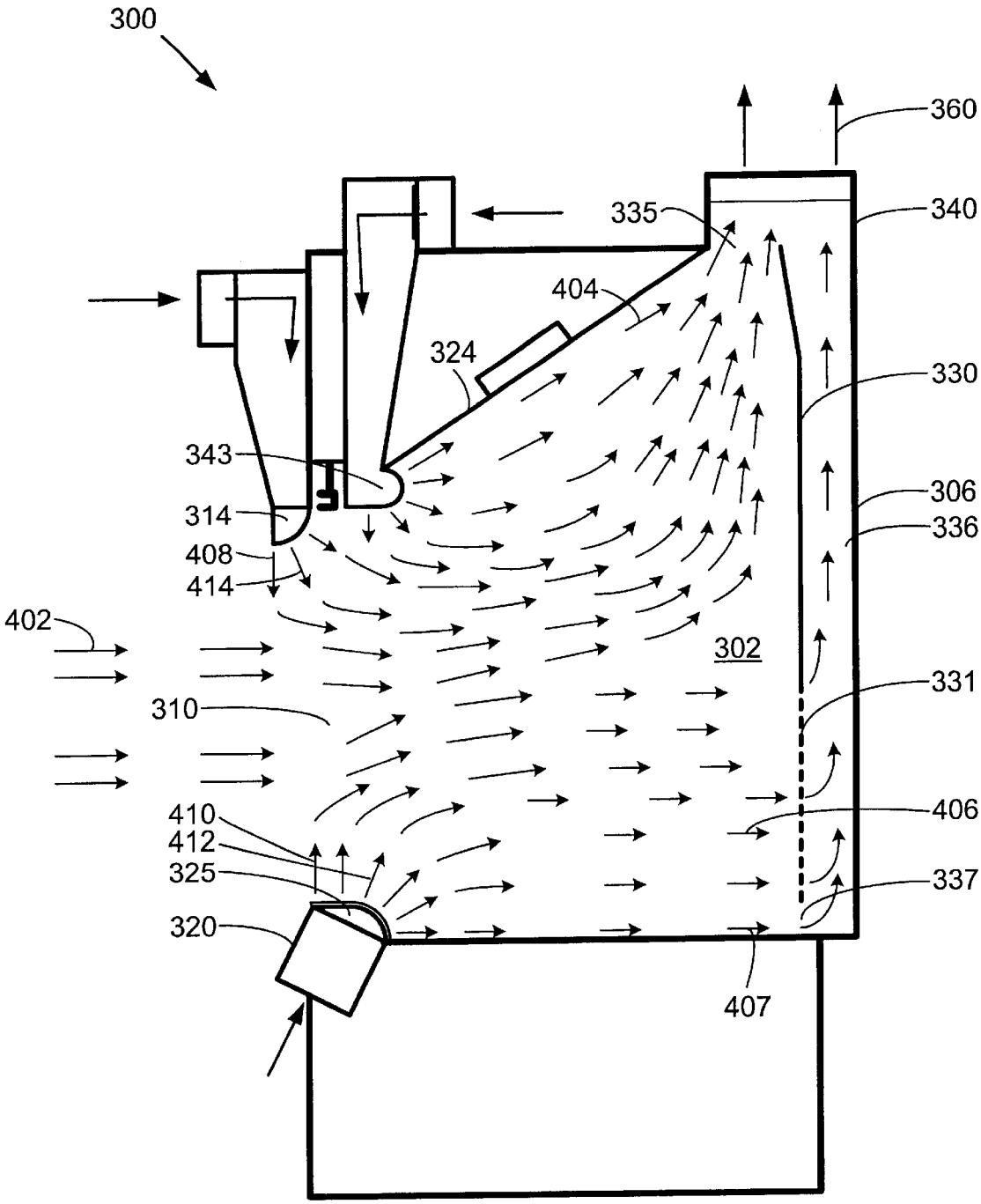
FIG. 4A is a cross-sectional side view of the fume hood of FIG. 3A showing of a mock-up displacement flow in accordance with the present invention.

The arrows in FIG. 4A depict the direction of air flow into, through, and out of the fume hood 300 as an example of displacement flow in accordance with one embodiment of the present invention. Air enters the work chamber 302 of the fume hood 300 through the supply air outlets 314, 325 and 343. In this embodiment, air is provided from the supply air outlets 314, 325 and 343 at about the same velocity over the width of each of the supply air outlets. When this is not the case, there may be areas of lower containment across the face 310. Air also enters the work chamber 302 directly through the open face 310 at an angle about perpendicular to the open face 310 from the room, as shown by arrows 402. Once inside the work chamber 302, the air is drawn more or less uniformly to and through the top chamber outlet 335, the perforated baffle 331 and the slot 337, as shown by arrows 404, 406 and 407 respectively. Once the air is passed through the top chamber outlet 335, the perforated baffle 331 and the slot 337, it is exhausted through an exhaust outlet 340 provided at the top rear of the hood 300 as shown by arrows 360.

Each of the outlets 314, 325 and 343 supply air in a number of directions according to the containment needs of a fume hood and displacement flow of the preset invention. As illustrated in FIG. 4A, the top and top 314 and bottom air sources 325 provide air at an angle about parallel with the open face 310, as shown by arrows 408 and 410 respectively. In addition, the top 314 and bottom air outlets 325 provide air into the work chamber 302 as indicated by arrows 414 and 412 respectively to facilitate displacement flow. By way of example, for the displacement flow of FIG. 4A, a portion of the air supplied by the bottom air source 325 travels substantially linearly towards and into the back baffle 331 and the slot 337 in a consistent and predictable manner along the bottom of the work chamber 302. Advantageously, this mitigates the formation of recirculation patterns at the working surface level of the work chamber 302, and thus undesirable accumulation of gas concentrations in this area.

The internal air supply outlet 343 provides air in a number of directions into the work chamber 302. A substantially flat portion of the internal air supply outlet 343 provides air at an angle substantially parallel to the open face 310, within the outer walls of the work chamber, and within the movable sash 316. In the embodiment shown, the internal air supply outlet 343 also provides air into the work chamber 302 to facilitate displacement flow. By way of example, the internal outlet 343 provides air in the direction of the top chamber outlet 335 to provide a consistent flow between the face and the top chamber outlet which minimizes vortices commonly found near the top of conventional fume hoods. In some embodiments, portions of the internal air supply outlet 343 may be blocked to limit flow in one or more directions and to facilitate displacement flow for a particular fume hood. It is also important to note that the internal outlet 343 will contribute to exhaust of contaminants from the work chamber 302 regardless of the position of the movable sash 316, and even when the sash is closed. In contrast, the air supply outlet 314 will not contribute to removal of gases within the work chamber 302 upon closing the movable sash 316.

In one embodiment, the top air outlet 314 also provides fresh air in the area immediately in front of the hood 300 towards the breathing zone of the operator to further reduce the risk of the operator breathing work chamber 302 contaminants. In another embodiment, the present invention relates to an 'air divider' which includes displacement flow as described herein in addition to an air barrier which comprises a substantial amount of air supplied in the face of the hood. In this case, the air supplied in the face of the hood may provide a buffer zone between contaminants in the work chamber and the surrounding room.

In one embodiment, the set of air supply outlets, work chamber outlets and structural features provide a displacement flow having a substantially consistent flow over the width of the work chamber 302 towards the chamber outlets. This set of air supply outlets, work chamber outlets and structural features is more effective in preventing spillage of contaminants from the work chamber 302 and minimizes mixing of supply air and work chamber contaminants.

Figure 4B:
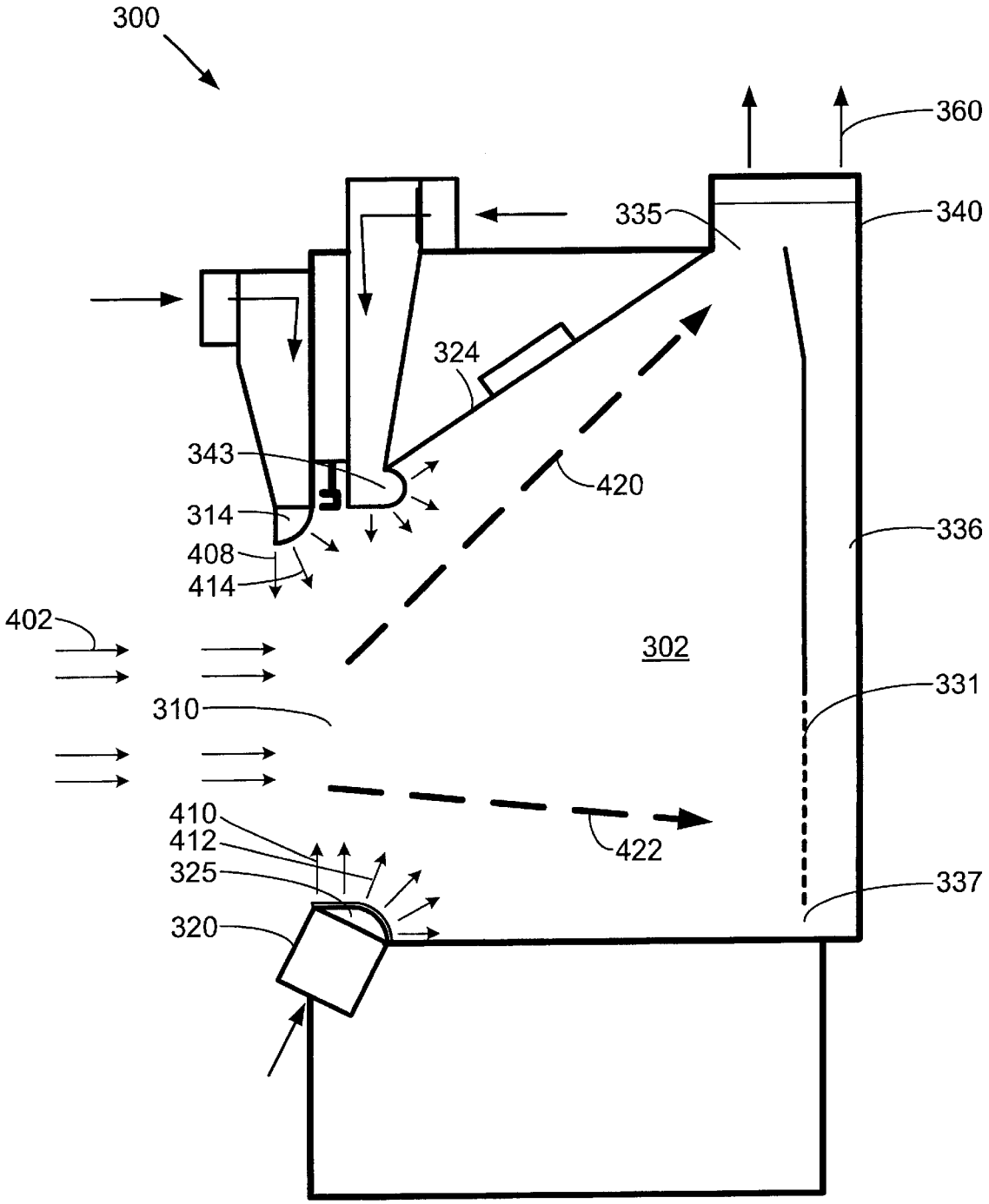
FIG. 4B is a cross-sectional side view of the fume hood of FIG. 3A showing of a mock-up for two lines of general flow in accordance with the present invention.

Referring to FIG. 4B, in accordance with one embodiment of the present invention, displacement flow within the fume with 300 operates upon a Bernoulli effect as air proceeds from the air supply outlets 314, 325 and 343 to the work chamber 302 and out the air outlets. Along a line of flow 420 from the face 310 to the work chamber 302 to the top chamber outlet 335, the cross-sectional area along the line of flow 420 varies to facilitate displacement flow in accordance with the present invention. More specifically, the cross-sectional area along the line of flow 420 increases substantially from the face 310 to the work chamber 302 before it decreases substantially between the work chamber 302 and the top chamber outlet 335. As one skilled in the art will appreciate, changes in the area along a line of flow will have effect on the velocity of the air. More specifically, air entering the face 310 will decrease in speed as it enters the larger area of the work chamber 302, and then increase in speed near the smaller area of the top chamber outlet 335. These changes in velocity help maintain a consistent and predictable flow from the air supply to the air exhaust and reduce flow speeds in work chamber 302. In addition, air slowing as it enters the work chamber 302 will minimize mixing of contaminants and fresh air in the work chamber 302. To facilitate withdrawal of the air near the top chamber outlet 335, an exhaust fan may gently pull on air near the top chamber outlet 335.

The fume hood 300 may implement multiple lines of displacement flow which operate in a substantially consistent and predictable manner. In addition to the line of flow 420, the fume with 300 includes a line of flow 422 (FIG. 4B) in which air proceeds from the face 310 to the work chamber 302 and to the back baffle 331 and the slot 337. Along the line of flow 422, the cross-sectional area increases substantially from the face 310 to the work chamber 302 before it decreases substantially between the work chamber 302 and the air outlets of back baffle 331 and the slot 337. Similar to flow along the line 420, these changes in area along a line of flow 422 will induce velocity changes in the air flow that minimize mixing of contaminants and fresh air in the work chamber 302 and facilitate a consistent and predictable flow from the air supply in the face 310 to the back baffle 331.

In accordance with one embodiment of the present invention, the fume hood 300 is designed to minimize turbulent effects in the work chamber 302 by controlling the flow from the supply air outlets 314, 325 and 343. In one embodiment, the air flow provided through the supply air outlets 314, 325 and 343 has a substantially laminar flow when exiting each of the outlets. In a specific embodiment, the air flow provided through the supply air outlets 314, 325 and 343 is as low as possible while providing the displacement flow according the present invention. As the air flow velocity emitted by the supply air outlets 314, 325 and 343 decreases, the lesser the occurrence of turbulent patterns and mixing of fresh air and contaminants in the work chamber 302. It should be noted that the air flow may be provided through the supply air outlets is not limited to laminar flow and may include small amounts of turbulent intensities, for example, from about 0% to 15%.

Each of the outlets 314, 325 and 343 may include an air distribution guide 326, 338 and 339 respectively to help distribute, balance, and direct fresh air from each of the air supply outlets. By way of example, the distribution guides 326, 338 and 339 all include a porous material shaped to the geometry of the outlet. The porous material allows substantially uniform passage of air from the air supply outlets 314, 325 and 343 to balance air supply across the width of the work chamber 302. In addition, as air supply into the air supply outlets from their respective plenums may be in a considerable state of turbulence when reaching the air distribution guide, the porous structure may serve to straighten and smooth the flow before introduction into the work chamber 302. In many cases, depending on the velocity of air supply to the air supply outlets 314, 325 and 343, the air distribution guides 326, 338 and 339 may provide air to the work chamber 302 having a substantially laminar flow.

In one embodiment, the air distribution guides 326, 338 and 339 all include a uniform wire mesh (for example: 100×100 mesh per inch, standard grade stainless steel, wire diameter 0.0045 inches, open surface 30.3%). In another embodiment, the air distribution guides 326, 338 and 339 are independently designed for the flow conditions at each air supply outlet 314, 325 and 343, e.g. they each have a different configuration or wire mesh size. For optimal energy efficiency, the use of a particular porous material is preferably coordinated with the speed of the air supply fans to achieve sufficient flow with minimal pressure drop at the supply outlets. The porous material should be selected to stand up to the rigors of normal hood operation, and may be composed of, for example a fabric, metal, plastic or alloy. In some embodiments, the bottom air source 325 also includes a protective grill 358 which provides mechanical protection for the screen 356 from frequent use associated with the bottom work area of the fume hood. The protective grill 358 may also be configured to aid in directing flow from the bottom air source 325 into the work chamber 302 and/or to improve laminar flow for air supplied by the bottom air source 325.

In addition to the air distribution guides 326 and the above designs for each of the inlet plenums 312, 320 and 343, other designs maybe implemented to provide a substantially even flow distribution across the width of the work chamber 302. By way of example, an air flow straightener may be added in proximity to one or more of the fans to break the rotating motion of air leaving a fan into the plenums. Alternatively, in the top plenum 343 for example, the longer the distance between the fan 342 and the turn from the horizontal to the vertical portion 345 of the plenum, the more even the distribution for the internal air supply outlet 343 becomes. Correspondingly, this distance may be increased to provide a substantially even flow distribution across the width of the work chamber 302. Additionally, air vanes may be incorporated into the plenums to ensure that the flow reaches both ends of the supply air outlets.

In the embodiment of the present invention shown in FIGS. 3A and 3B, air is supplied from supply air outlets 314, 325 and 343 at the top outside, bottom and top inside of the hood, respectively, with the top supply air outlets 325 and 340 located on either sides of the sash 316. It should be noted that it may also be possible to have supply air outlets (or a single outlet) located in other positions in the fume hood, as long as it/they are suitably capable of containing gases within the work chamber 302. Moreover, while the supply air outlets 314, 325 and 343 in the embodiment illustrated in FIGS. 3A and 3B include one or both of a flat portion perpendicular to the open face 310 and a curved portion with a substantially consistent radius of curvature, other geometries for supply air outlets may also be used. For example, the curved portion 353 may be substantially radial, or it may not necessarily be a smooth curve, but may also be formed by a series of substantially straight sections angled to each other so as to follow a curved trajectory.

To facilitate a substantially consistent air flow profile across the width of the work chamber 302, air exhaust outlets included in the fume hood 300 may also be designed to provide a substantially consistent exit across the width of the work chamber 302. For example, the top chamber outlet 335 has a rectangular shape that spans the width of the work chamber 302 and provides a substantially consistent air outlet across the width of the work chamber. Similarly, the slot 337 has a rectangular shape that spans the width of the work chamber 302 and provides a substantially consistent air outlet across the width of the work chamber. Further, as will be described in further detail below, holes 333 in a back baffle 331 span the width of the work chamber 302 and provide a substantially consistent air outlet across the width of the work chamber.

Having briefly discussed a specific example of displacement flow, as well as air supply outlets and work chamber outlets which may facilitate displacement flow in accordance with one embodiment of the present invention, other features of the present invention will now be discussed. As mentioned before, the present invention includes a number of structural adaptations to conventional fume hood designs to facilitate containment of contaminants with the fume hood 300, one or more of which may be included in various embodiments of the present invention.

In one embodiment, the fume hood 300 includes an angled top wall 324 partially enclosing the work chamber 302 and connected at its sides to the side enclosure panels 303, running upwards at an angle towards the back of the hood 300 and connected with the top enclosure panel 304. The angle and shape of the angle top wall 324 is designed to facilitate containment of contaminants within the work chamber 302. In a specific embodiment, the angled top wall 324 is designed to minimize vortices near the top chamber outlet 335. In the embodiment shown, the angled top wall 324 extends from the top chamber outlet 335 to an area proximate to the front open face 310. More specifically, the angle top wall 324 extends from the internal air supply outlet 343 to the top chamber outlet 335.

In another specific embodiment, the angle top wall 324 is configured to facilitate displacement flow within the work chamber 302. The angled top wall 324 allows the cross-sectional area and corresponding velocity of air along the line of flow 420 to be controlled near the top chamber outlet 335 In one embodiment, the angled top wall 324 is flat and makes an angle 328 between about 30 and 60 degrees with the top enclosure panel 304. A light 329 for illuminating the work chamber may be enclosed within the angled top wall 324 and the top enclosure panel 304.

The hood 300 includes a back wall 330 connected at its sides to the side enclosure panels 303, running upwards about parallel to the back enclosure panel 306 and angling slightly towards the front of the hood 300 at its top to connect with the top enclosure panel 304. A rear duct 336 is provided by the space between the back wall 330 and the back enclosure panel 306 and leads to the exhaust outlet 340. The back wall 330 includes the back baffle 331 which provides a porous barrier through which air in the work chamber 302 passes from the work chamber 302 to the rear duct 336 and exits to the exhaust outlet 340. Below the back baffle 331 is the slot 337 which extends across the width of the work chamber 302 and allows air to exit from the bottom of the work chamber 302 to the rear duct 336 and out the exhaust outlet 340.

The back baffle 331 is perforated with holes to provide an exhaust for gasses within the work chamber 302. The back baffle 331 is perforated with holes 333, for example, about 0.25 inches in diameter, distributed evenly over the baffle 331. In another embodiment, the holes 333 are distributed in a pattern designed to achieve displacement flow in the work chamber 302 based on the position of the supply air outlets 314, 325 and 343. The height of the back baffle 331 may vary according to the fume hood and in some cases extends to the height of the front open face 310. As illustrated in FIG. 3B, the back baffle 331 extends the width of the work chamber 302 and to a height less then half the height of the front open face 310.

The dimensions suitable for use with the present invention may vary widely based on, for example, the geometry of the work chamber and the size of the fume hood. For the embodiment shown in FIGS. 3A and 3B, the supply air plenum 312 tapers in depth at its upper portion relative to the fan 315 diameter (e.g., ¾ to 1.5 times the fan 315 diameter) to the radius of supply air outlet 314 and extends across the whole width of the chamber 302. The air supply outlet 314 spans a 90 degree angle facing down and into the work chamber 302 and has a radius of about ¾ inches to 2 inches for this embodiment. The air plenum 340 which supplies the internal air supply outlet 343 may taper in depth at its upper portion relative to the fan 342 diameter (e.g. ¾ to 1.5 times the fan 342 diameter) to a range of about 1 to 3 inches in depth at its lower portion and extends the whole width of the chamber 302 in this embodiment. The internal supply air outlet includes a substantially flat portion 351 of about 1 to 3 inches and a curved, substantially radial, portion 353 that spans between about 45 and 180 degrees with a radius of curvature of about 1 to 2 inches for this embodiment. The air plenum 320 which supplies the bottom air supply outlet 325 is square with sides ranging from about 2 to 6 inches and extends the whole width of the chamber 302 in this embodiment. The air supply outlet 325 comprises a substantially radial portion 352 having a radius of curvature ranging from about 1½ inches to 3 inches extended by a substantially flat portion 354 ranging in length from about ¾ inches to 4 inches. Fans 315, 342 and 321 may range in diameter from 3 to 5.5 inches for this embodiment. The angled top wall 324 runs at an angle between about 30 and 60 degrees from a top portion of the internal outlet 343 to the top chamber outlet 335 which is about 5 inches in breadth which spans the work chamber 302. The perforated back baffle 331 runs to a height of half the open face 310 height and leaves a space of about 1 to 2.5 inches for the slot 337 which spans the work chamber 302.

In a specific embodiment, the supply air plenum 312 tapers in depth at its upper portion from about 1.5 times the fan 315 diameter to about 2 inches in depth at its lower portion and extends across the whole width of the chamber 302. The air supply outlet 314 spans a 90 degree angle and has a radius of about 2 inches for this embodiment. The air plenum 340 tapers at its upper portion from about 1.5 times the fan 342 diameter to about 2 inches in depth at its lower portion and extends the whole width of the chamber 302 in this embodiment. The internal supply air outlet 343 includes a flattened portion 351 of about 2 inches and a curved portion 353 that spans about 180 degrees with a radius of curvature of about 1¼ inches for this embodiment. The air plenum 320 which supplies the bottom air supply outlet 325 has square sides of about 4 inches and extends the whole width of the chamber 302 in this embodiment. The air supply outlet 325 comprises a substantially radial portion 352 having a radius of curvature about 2½ inches extended by a substantially flat portion 354 about 3 inches in length.

The dimensions provided for this specific embodiment are intended for a fume hood which is about 4 feet wide (exterior dimension) with about 4 inch side walls, and having a sash opening of approximately 31 inches in height by 38 inches in width, and an interior height of about 52 inches. It should be understood that fume hoods in accordance with the present invention may be designed to have whatever dimensions are required for an intended application, and therefore the invention is in no way limited to the dimensions provided in this embodiment.

As displacement flow in accordance with the present invention allows a fume hood to use substantially less air than a conventional fume hood, energy efficiency achievable with a displacement flow fume hood is greatly improved. In one embodiment, it is preferable to maximize the air flow supplied to the work chamber 302 via the supply air outlets, consistent with safe and effective operation of the fume hood. In one embodiment, a large portion, for example 45 to 90%, of the air exhausted from the work chamber 302 is supplied by the supply air outlets 314, 325 and 343, with the remaining air coming directly through the face 310. In a preferred embodiment, 65 to 85% of the air exhausted from the work chamber 302 is supplied by the air supply outlets 314, 325 and 343, with the remaining air coming directly through the face 310. This division of air supply flow may be achieved by providing air through the supply air outlets in a variety of ways.

In one embodiment, air is emitted form the supply air outlets 314, 325 and 343 at the same speed with a flow velocity in the range of about 30 fpm to 90 fpm (about 0.15 m/s to 0.46 m/s). In this case, the pressure drop at the supply air outlets 314, 325 and 343 may be about 1.5 Pa to 3.0 Pa. In another embodiment, air is supplied to the supply air outlets 314, 325 and 343 by each of their respective fans at an independent rate, each having a different flow velocity in the range of about 30 fpm to 90 fpm, for example. The ratio or amount of air independently supplied by each of the air supply outlets to the work chamber 302 may vary according to a number of factors including, for example, the geometry and position of the air supply outlets, the total exhaust air flow, the work chamber 302 geometry, and a desired air flow pattern within the fume hood. In a specific embodiment, the fan 315 supplies air at a flow rate about 70 CFM, the fan 321 supplies air at a flow rate about 50 CFM, and the fan 342 supplies air at a flow rate about 90 CFM. In this case, air supplied by the air outlets 314, 325 and 343 represents 87% of the total air exhausted from the fume hood 300.

The air exhausted from the fume hood 300 may be as low as 30% of that exhausted from a conventional fume hood resulting in substantial energy savings due to reduced air conditioning requirements. By way of example, the air exhausted from the fume hood 300 maybe in the range of about 30 to 50% of fume hood with a typical face velocity of 100 fpm. In addition, reducing the quantity of exhaust air may lead to lower velocities for air entering the face 310, which may reduce the effects of operator induced wake and the risk of spilling contaminants from the fume hood 300 into the ambient room. More specifically, since a large portion of the air to be exhausted is supplied by the air supply outlets 314, 325 and 343, a person standing in front of the hood has a minimal influence on flow through the face 310. Therefore, the danger of inconsistent flow at the face 310 is substantially reduced with a fume hood in accordance with the present invention.

It should be noted that in one embodiment of the present invention described herein, many measures are taken to achieve optimal flow distribution, without increasing the pressure drop of the outlets. However, these measures are not necessary, and could or least be relaxed in hood designs where significant pressure drop (which costs fan power—and fan energy) occurs. That is, implementation of the aspect of the invention that supplies air within the fume hood to provide a displacement flow which minimizes inconsistent and turbulent air patterns within the hood, without optimizing the energy savings from such implementation is still within the scope of the present invention. Moreover, such measures may not be necessary to achieve substantial energy saving in all implementations.

Fume hoods in accordance with the present invention used in a laboratory may reduce the laboratory's energy consumption and peak-power requirements for fan and make-up air conditioning energy. Because of this reduced make-up air requirement, air conditioning equipment may be downsized, which reduces initial equipment costs and space requirements for the air handler and the duct work of a laboratory facility.

In addition, because of the multiple-fan position arrangement of the fume hood embodiment described with relation to FIG. 3A (one fan near the entrance of each the three air plenums directing air into the plenums and into the work chamber through supply air outlets, and another fan in the exhaust duct) fume hoods in accordance with some embodiments of the present invention are safer in case of an equipment failure. Embodiments of the present invention may also be equipped with a warning device to signal fan failure for each of the fans in a fume hood.

Further, powdery substances used inside conventional fume hoods are often lost in part as high velocity turbulent air flow may suck powder off the work area and directly into the exhaust. The reduced turbulence air flows in the work chamber of a displacement flow fume hood in accordance with the present invention have suitably small velocities such that there is less eminent danger of powder chemicals becoming airborne.

Although the present invention has been discussed primarily with respect to the fume hood 300 which incorporates many of the structural features described above, these alternative structural features and displacement flow techniques may be used, either alone or in combination, with any conventional fume hood. By way of example, one or more of the alternative structural features described above, such as an air outlet which spans the width of the work chamber, may be implemented on any conventional fume hood such as a LabConco fume hood as provided by LabConco Inc. of Kansas City, Mo. In addition, one or more of the displacement flow techniques of the present invention are not limited to use with the fume hood configuration as described herein and may be suitable for use with any conventional fume hood.

Although the foregoing invention has been described in some detail for purposes of clarity of understanding, it will be apparent that certain changes and modifications may be practiced within the scope of the appended claims. By way of example, although the present invention has been discussed primarily with respect to displacement flow for the fume hoods of the present invention, the present invention is not limited to displacement flow air supply and may include the use of air supplied at high flow rates and may include turbulent effects. In addition, although the present invention is described in terms of a back baffle having holes distributed in a pattern designed to achieve displacement flow within the work chamber, the back baffle may include any arrangement of holes suitable for providing containment of gases and contaminants in the work chamber. Further, although the present invention has been described with only one fan for each air supply plenums, multiple fans may be used for each plenum, e.g. using a fan at each end of the plenum for the bottom air supply outlet. Further still, although the present invention has been described in terms a preferred embodiment comprising two or three horizontal air supplies, other air supplies, such as one or more vertical supplies located near the face of the hood, may be used. Accordingly, the present embodiments are to be considered as illustrative and not restrictive, and the invention is not to be limited to the details given herein, but may be modified within the scope and equivalents of the appended claims.

What is claimed is:

1. A fume hood, comprising:

a partially enclosed work chamber having a front open face;

a first top air source at the face of the work chamber;

a second top air source inside the face of the work chamber;

a moveable sash capable of covering the open face, wherein the sash opens vertically between the first top air source and the second top air source;

a bottom air source at the face of the work chamber; and at least one air exhaust out let from the work chamber.

2. A fume hood according to claim 1, further including a top angled wall partially enclosing the work chamber.

3. A fume hood according to claim 2, wherein the top angled wall extends from proximate to the front open face to a chamber outlet near the top the work chamber.

4. A fume hood according to claim 2, wherein the top angled wall facilitates displacement flow from the front open face to the chamber outlet near the top the work chamber.

5. A fume hood according to claim 2, wherein the top angled wall extends at least partially from the second top air source to the chamber outlet near the top the work chamber.

6. A fume hood according to claim 1, wherein the at least one air exhaust outlet includes a chamber outlet which extends substantially across the width of the work chamber.

7. A fume hood according to claim 6, wherein the chamber outlet is located near the top of the work chamber.

8. A fume hood according to claim 6, wherein the chamber outlet is substantially rectangular.

9. A fume hood according to claim 6, wherein the chamber outlet provides substantially consistent air exhaust across the width of the work chamber.

10. A fume hood according to claim 1, wherein the at least one air exhaust outlet includes a rear duct which extends at least partially behind a back wall of the work chamber.

11. A fume hood according to claim 10, wherein the back wall comprises a back baffle perforated with holes separating the work chamber from the rear duct.

12. A fume hood according to claim 11, wherein the back baffle is perforated with holes to a height less than half of the front open face height.

13. A fume hood according to claim 11, wherein the work chamber further includes a slot below the back baffle which extends substantially across the width of the work chamber and allows gaseous communication between the work chamber and the rear duct.

14. A fume hood according to claim 1, wherein the second top air source includes a curved portion.

15. A fume hood according to claim 14, wherein the curved portion is substantially radial and supplies air over an arc between about 45 degrees and 180 degrees.

16. A fume hood according to claim 14, wherein the curved portion supplies air in the direction of a chamber outlet located near the top of the work chamber.

17. A fume hood according to claim 1, wherein the bottom air source includes a plenum which spans the width of the front open face.

18. A fume hood according to claim 17, wherein the plenum comprises one or more plenum air guides.

19. A fume hood according to claim 1, wherein one of the bottom, first top and second top air sources comprise an air distribution guide.

20. A fume hood according to claim 19, wherein the air distribution guide is configured to direct air towards a chamber outlet of the work chamber.

21. A fume hood according to claim 20, wherein the air distribution guides comprises a mesh material.

22. A fume hood according to claim 1, wherein the bottom air source comprises a flat portion and a curved portion.

23. A fume hood according to claim 1, wherein the bottom air source further includes a protective grill.

24. A fume hood according to claim 1, further including a first fan which supplies air for the first top air source, a second fan which supplies air for the second top air source fan, and a third fan which supplies air for the bottom air source fan.

25. A fume hood according to claim 24, wherein the first fan, the second fan, and the third fan supply an air flow at a rate independent from each other.

26. A fume hood according to claim 25, wherein the first fan, the second fan, and the third fan supply an air flow at a rate between about 30 and 90 cubic feet per minute.

27. A fume hood according to claim 1, wherein the supply air emitted through the first top air source, the second top air source and the bottom air source has a substantially laminar flow.

28. A fume hood according to claim 1, wherein air is emitted from the first top air source, the second top air source and the bottom air source a velocity between about 30 feet per minute and 90 feet per minute.

29. A fume hood according to claim 1, wherein air emitted from the first top air source, the second top air source and the bottom air source comprises between about 50 and about 90% of air exhausted from the work chamber.

30. A fume hood according to claim 1, wherein the one or more supply sources supply air at a pressure between about 1.5 and 3 Pa.

31. A fume hood, comprising:

a partially enclosed work chamber having a front open face;

a first top air source at the face of the work chamber;

a second top air source inside the face of the work chamber;

a moveable sash capable of covering the open face, wherein the second top air source supplies air in a direction which substantially prevents air from escaping the work chamber when the sash is open and when the sash is closed;

a bottom air source at the face of the work chamber; and at least one air exhaust outlet from the work chamber.

* * * * *